US006184193B1

(12) United States Patent
Yamada

(10) Patent No.: US 6,184,193 B1
(45) Date of Patent: Feb. 6, 2001

(54) WET CLEANING SYSTEM WITH SHRINKAGE PREVENTION AGENT

(75) Inventor: Yukio Yamada, Chiba (JP)

(73) Assignee: Nippon Mic, Co., LTD, Shizuoka-Ken (JP)

( * ) Notice: Under 35 U.S.C. 154(b), the term of this patent shall be extended for 0 days.

(21) Appl. No.: 09/445,737

(22) PCT Filed: Jun. 11, 1998

(86) PCT No.: PCT/IB98/01106

§ 371 Date: Mar. 31, 2000

§ 102(e) Date: Mar. 31, 2000

(87) PCT Pub. No.: WO98/56975

PCT Pub. Date: Dec. 17, 1998

(30) Foreign Application Priority Data

Jun. 12, 1997 (JP) ..... 9-155593

(51) Int. Cl.[7] ..... D06L 1/02

(52) U.S. Cl. ..... 510/291; 510/339; 510/442; 510/444; 510/462; 510/463; 8/137; 8/158; 34/418; 34/61

(58) Field of Search ..... 34/418, 499, 60, 34/61, 596, 597; 8/137, 158, 159; 69/12.12, 19.2; 510/276, 285, 291, 292, 438, 442, 444

(56) References Cited

U.S. PATENT DOCUMENTS

| | | | | |
|---|---|---|---|---|
| H1818 | * | 11/1999 | Potgieter et al. | 510/422 |
| Re. 33,210 | | 5/1990 | Stoufer | 252/153 |
| 3,712,087 | | 1/1973 | Zucchini | 68/18 C |
| 4,091,643 | | 5/1978 | Zucchini | 68/18 C |
| 4,098,582 | | 7/1978 | Takeda | 23/293 R |
| 4,270,576 | | 6/1981 | Takeda et al. | 137/888 |
| 4,438,009 | | 3/1984 | Brusky et al. | 252/90 |
| 4,444,625 | | 4/1984 | Smith | 203/95 |
| 4,712,392 | | 12/1987 | Hagiwara et al. | 68/18 C |
| 4,802,253 | | 2/1989 | Hagiwara et al. | 8/158 |
| 4,844,821 | * | 7/1989 | Mermelstein et al. | 252/8.7 |
| 4,874,472 | | 10/1989 | Kohler | 202/169 |
| 4,879,888 | | 11/1989 | Suissa | 68/18 |
| 4,912,793 | | 4/1990 | Hagiwara | 8/158 |
| 5,069,755 | | 12/1991 | Durr et al. | 202/169 |
| 5,076,854 | | 12/1991 | Honda et al. | 134/1 |
| 5,213,624 | | 5/1993 | Williams | 134/40 |
| 5,311,671 | | 5/1994 | Brooks et al. | 34/66 |
| 5,474,749 | | 12/1995 | Takeda | 422/186.07 |
| 5,498,266 | | 3/1996 | Takagawa et al. | 8/142 |

FOREIGN PATENT DOCUMENTS

| | | | | |
|---|---|---|---|---|
| 11001699 | * | 1/1999 | (JP) | C11D/7/26 |

* cited by examiner

*Primary Examiner*—Stephen Gravini
(74) *Attorney, Agent, or Firm*—Sidley & Austin

(57) ABSTRACT

A shrinkage prevention agent for water washing of clothing that would conventionally have been dry cleaned. The shrinkage prevention agent is compromised of a steam or vacuum dry-distilled liquid of two or more plants selected from sagebrush, beefsteak plant, tea, plantaginales, aloe, chrysanthemum, pine, cedar, cypress. The shrinkage prevention agent is used in a wet cleaning system that includes water washing.

16 Claims, No Drawings

WET CLEANING SYSTEM WITH SHRINKAGE PREVENTION AGENT

BACKGROUND OF THE INVENTION

The present invention relates to wet cleaning systems and, in particular, a wet, or water-based, cleaning system for articles of clothing that have been conventionally dry cleaned. In addition to providing a system for wet cleaning of clothing, the present invention relates to a novel shrinkage prevention agent for use in such a wet cleaning system. The antishrink or shrinkage prevention agent minimizes or prevents the shrinkage of fabric, cloth, clothing, and articles made of hair, silk, rayon, animal hair, animal skin, mixed spun material, and other similar materials that are likely to shrink when washed in water. The system of the present invention includes a method for washing in water of items that would be conventionally dry cleaned, using the novel shrinkage prevention agent.

In general, cleaning in the clothing cleaning industry can be divided into dry cleaning and wet cleaning, which is washing in water. In order to avoid shrinkage caused by washing in water, many clothing items are conventionally dry cleaned. These types of clothing include fabric and other clothing made of hair, silk, rayon, animal hair, animal skin, and mixed spun materials, all of which have a tendency to shrink when they are washed in water. Therefore, at the present time, these items are conventionally only cleaned by dry cleaning. Dry cleaning employs solvents for cleaning, such as chloroethylene, 1,1,1-trichloroethane, 1,1,2-trichloro-1,2,2-trifluoroethane, and perchloroethylene, which is commonly known as "perc." Each of these solvents contain chlorine and they present environmental problems of ozone layer destruction, ground-water pollution, as well as the presence of carcinogenic substances. Accordingly, environmental regulations are restricting the use of freon-system or halogenated solvents, such as the above solvents.

Several prior art systems have been proposed for wet cleaning of clothing that is conventionally dry cleaned. U.S. Pat. No. 5,634,947 to Kazama discloses a wet cleaning system that uses a solvent of propylene glycol monomethyl ether containing 4% to 50% by volume of water. The Kazama patent does not teach or disclose the use of the natural plants and chemical substitutes used in the shrinkage prevention agent of the present invention.

Japanese Patent Application Laid-open No. 7-268,766 discloses a wet cleaning method for items that should be dry cleaned by using shrinkage prevention agent containing a water repelling silicone emulsion, such as water-repellant dimethylpolysiloxane oil, or amine-modified silicone oil, in combination with a detergent.

Japanese Patent Application Laid Open No. 6-340,897 discloses a degreasing agent that contains a water or hot water extract of tea as its active component. The extract is obtained by extracting a nonfermented tea such as green tea, a semifermented tea such as oolong tea, or a fermented tea such as black tea. The degreasing agent is formed by a mixture of one or more of such extracts and then is subjected to ultrasonic vibration.

As noted above, conventional dry-cleaning solvents, such as perc, present environmental pollution problems. Similarly, the silicone emulsion that is disclosed in the Japanese Pat. Application Laid-Open No. 7-268766 is a nonflammable synthetic chemical substance that presents a ground-water pollution problem, to a degree. Flammable petroleum solvents used instead of the above silicone emulsion can ignite or explode, which also presents safety problems. In addition, dry cleaning with various solvents used to prevent shrinkage do not provide suitable cleaning of water-soluble salt-containing contaminants, such as perspiration, although those solvents can be effective for removal of oil-based stains.

On the other hand, the degreasing detergent of Japanese Patent Application Laid-Open No. 6-340,897 is comprised of extracts of tea so it does not present environmental pollution problems. However, the tannin contained in the tea extract can discolor clothes when it is used for washing clothing. Therefore, although the degreasing agent is suitable for cleaning or degreasing of specific precision machines, it is not suitable for washing clothes.

SUMMARY OF THE INVENTION

The present invention is directed to a shrinkage prevention agent that permits water washing of clothes and other items that would conventionally be dry cleaned. The shrinkage prevention agent minimizes or prevents shrinkage of the clothing during water washing and also does not discolor the clothes during water washing. The present invention is also directed to a cleaning method or system that includes the use of such a shrinkage prevention agent for washing clothing in water.

In one embodiment, the present invention is directed to a shrinkage prevention agent that is formed by steam distillation or vacuum dry distillation of extracts of several natural plants. When such an agent is used for water cleaning of items that should be conventionally dry cleaned, no shrinkage or minimal shrinkage occurs in those items.

That is, the present invention relates to a shrinkage prevention agent for water washing, comprised of a steam distillation liquid and/or a vacuum dry distillation liquid of two or more plants selected from, for example, extracts of sagebrush, beefsteak plant, tea, plantaginales, aloe, chrysanthemum, pine, cedar and cypress and which contains at least one organic acid, having terpene and phenol as its effective components. The shrinkage prevention agent is comprised of a steam distilled liquid from which the oil in the steam distillation liquid is removed and/or a vacuum distillation liquid from which the initial fraction rich in lower alcohol or acetone is removed.

In addition, in several embodiments, the present invention relates to a system for wet cleaning of clothing with natural fibers that utilizes a shrinkage prevention agent that contains at least one organic acid with terpene and phenol as its effective components. The system permits the washing in water of items that are conventionally dry cleaned, such as fabric, cloth, and clothing made of hair, silk, rayon, animal hair, animal skin, mixed spun material and similar natural fibers. The washing system includes a low agitation soak cycle; cleaning assisted by microbubbles formed from turbulent mixing of air, water and the shrinkage prevention agent; and, is followed by a limited time, high powered drying cycle to remove remaining moisture from the clothing.

In this invention, the shrinkage prevention agent acts to remove oil-soluble and water-soluble contaminants in addition to performing the function of shrinkage prevention. Such contamination-removing action is considered to be due to the shrinkage prevention agent's stronger affinity to fibers than with the contaminating components because of the surfactant content in the shrink prevention agent.

The plants that can be used to produce the shrinkage prevention agent of this invention include sagebrush, beefsteak plant, tea, plantaginales, aloe, chrysanthemum, pine, cedar or cypress, orange, tangerine, and similar plants. The skin, bark, stem, leaves, flower or root of these plants can be used. In one preferred embodiment of this invention, at least two or more of these plants are used on account of the uneven shrinkage prevention effect or cleaning effect produced by steam distillation liquid or vacuum dry distillation liquid of any one type of plant. Thus, depending on the type of fiber or contamination, at least two or more plants are used to assure proper cleaning of the clothing fibers.

As mentioned above, use of multiple types of plants is desirable for an effective shrinkage prevention agent. When multiple types of plants are used, the types of effective components contained in the shrinkage prevention agent increases and, at the same time, their content ratio becomes more uniform and the antishrink action is exhibited against more types of contaminants and more types of laundry items.

DESCRIPTION OF THE PRESENTLY PREFERRED EMBODIMENTS

Conventional dry cleaning utilizes petrochemical solvents such as perc that dissolve certain stains in clothing. Typically, the clothing is immersed in solvent in a rotating drum. The solvent acts upon the stains and contaminants in the clothing during an agitation or soak cycle. The high-speed rotation of the drum in a spin cycle following the soak cycle causes some of the solvent to be driven from the clothing, with the remainder to be driven off by evaporation (drying). The evaporative nature of perc is such that the drying process typically requires only a small amount of energy or heat to remove the remaining perc from the clothing.

Use of water is typically avoided or minimized in such conventional dry cleaning systems. This is on account of the attachment of water to the clothing and textile fibers in water cleaning systems, which causes the clothing fibers to expand. When the clothing is subsequently dried and the water is removed from the fibers, then the fibers are caused to shrink, which results in shrinkage of the clothing.

As presently understood, the shrinkage prevention agent of the present invention acts to attach itself to various locations on the textile fibers. By contacting the textile fibers, and attaching itself to the fibers, the shrinkage prevention agent acts to repel water from the fibers and prevents water absorption by the fibers. It is presently understood that shrinkage is minimized or prevented by preventing or minimizing the amount of water that can attach to the fibers.

The shrinkage prevention agent of the present invention preferably contains at least one organic acid, with terpene and phenol of plant origin as its effective components. The shrinkage prevention agent can be produced by steam or vacuum dry distillation of naturally occurring plants. The amounts of organic acid, with terpene and phenol of plant origin, and the amounts and ratio of organic acid to other components, differs depending upon the type and the portion of the plant that is used, i.e., plant leaves, flowers or roots, as well as the harvesting time and location. In its preferred embodiments, the shrinkage prevention agent includes acetic acid, cyclotene, 2-cyclopentenone, para-cresol, meta-cresol, orthocresol, furfuryl alcohol, guaiacol, ethyl guaiacol, in addition to the following in trace amounts: propionic acid, crotonic acid, isocaproic acid, catechol, phenol, crotonaldehyde, allyl alcohol, propanol, levoglucosan, acetol, maltitol, isoflavone, liquiritin, plantagin, limonene, cineole.

The shrinkage prevention agent is prepared by the steam or vacuum distillation of bark, leaves, stems or flowers of two or more plants selected from the group including sagebrush, beefsteak plant, plantaginales, tea, chrysanthemum, pine, cedar or cypress. The leaves, stems or flowers can be dried or used immediately after harvesting, but the latter is preferable for minimization of change in the components. When the wood part of the pine, cedar or cypress is used, it can be dry or used immediately after collection.

Bark, leaves, stems, flowers or roots of the plant can be steam-distilled by direct injection of steam into a container in which a mixture of the above materials is stored or water can be added to the container for heating instead of steam injection. Although the time required for steam distillation depends on the type and amount of the plant used, it is normally for approximately 30 minutes and the oil in the distilled liquid is removed to produce the shrinkage prevention agent. When the floating oil is not removed, a residue of white powder can form on the laundry items when dried. In addition, this oil dilutes the effective components and causes a variation in the amount of agent that must be added for washing in water.

For vacuum dry distillation, the container in which the plant parts are stored (bark, leaves, flowers or roots) of the plant is depressurized down to, for example, 50–200 mmHg and, at the same time, is heated to 40–250° C., preferably 200° C. In this case, gradual depressurization and heating are preferable. The vacuum in the container can block air and prevent decomposition of the effective components due to normal pressure heating. Next, the generated gaseous components are cooled to obtain the vacuum dry distilled liquid containing the effective components, except, the removal of the initial fraction of this distillation liquid containing a large amount of lower alcohol, acetone, and the like, is preferable. This vacuum distillation is especially suitable for the wood part of pine, cedar, and cypress. When the initial fraction containing lower alcohol, acetone, and the like, is not removed, however, the liquid produced can have an irritating odor or the container can expand during storage.

Steam distillation and vacuum distillation processes are known in the art. To prepare the shrinkage prevention agent of the present invention, 3 parts to 20 parts of each of two or more plants are mixed in advance for steam distillation or vacuum dry distillation. The process efficiency is improved by this processing of combined plants, but the harvesting time of the plants can cause a variation in the available components. To avoid such variation, separate distillation of each plant and later mixing of the various effective components containing liquids, is preferable. This latter method is also desirable for avoidance of mixing in of the oil component, lower alcohols, acetone, and similar components. Separate steam or vacuum dry distillation allows for checking of the contained effective component prior to final mixing and adjustment of the content of the agent. Normally, colored components of the plants, such as tannin, chlorophyll, and the like, are removed by the steam or vacuum dry distillation process. However, if the distilled liquid remains colored, activated charcoal can be used for removal of the colored component by adsorption filtering.

Naturally occurring plants that may be preferably utilized in the shrinkage prevention agent of the present invention include the following plants, which are listed by their common name and Latin name:

| | | |
|---|---|---|
| 1. | Black pine | *Pinus Thunbergii Parl.* |
| 2. | Red Pine | *Pinus densiflora Sieb. et Zucc.* |
| 3. | Ezo Spruce | *Picea jezoensis Carr.* |
| 4. | Cypress | *Chamaecyparis obtusa Endl.* |
| 5. | Fir | *Abies Firma Sieb. et Zucc.* |
| 6. | Camphor tree | *Cinnamonum Camphora* |
| 7. | Khaki (Japan persimmon) | *Diospyros khaki Thunb.* |
| 8. | White birch | *Betula platyphylla* var. Japonica |
| 9. | Mulberry tree | *Morus alba* |
| 10. | Cherry tree | *Prunus yedoensis* |
| 11. | Japanese apricot (ume) | *Prunus mume* |
| 12. | Rice leaves (ina) | *Oryza Sativa* |
| 13. | Tea | *Camellia Sinensis* |
| 14. | Sasabamboo | *Sasa veitchii Rehder* |
| 15. | Mugwort | *Artemisia princeps* |
| 16. | Perilla | *Lavandula vera / Perilla frutescens* |
| 17. | Hydrangea tea vine | *Cynostemma pentaphyllum* |
| 18. | Carrot | *Panax spp./ Daucus Carota* |
| 19. | Bamboo | *Phyllostachys pubescens* |
| 20. | Leek | *Alium porum* |
| 21. | Dropwort | *Cennanthe phellandrium* |
| 22. | Cinnamon | *Cinnamonum Cassia* |
| 23. | Nutmeg | *Myrutica fragrans* |
| 24. | Corn | *Zeamays* |
| 25. | Bamboo shoot | *Phyllostachys pubescens shoot* |
| 26. | Soybeen | *Glycine max* |
| 27. | Aloe | *Aloe vera* |
| 28. | Japanese pepper tree | *Xanthoxylum piperitum* |
| 29. | Lemon | *Citrus limonum* |
| 30. | "Mikan" tangerine | *Citrus reticulata* |
| 31. | Chrysanthemum | *Chrysanthemum morifolium* |
| 32. | Grape | *Vitus spp.* |
| 33. | Butterbur | *Petasites Vulgaris* |
| 34. | Green onion | *Allium fistulosum* |
| 35. | Fig tree | *Ficus Carica* |
| 36. | Spinach | *Spinacia oleracea* |
| 37. | Celery | *Apium graveolens* |
| 38. | Plum | *Prunus salicina* |
| 39. | "Daikon" radish | *Raphanus Sativus* var. *hortensis* |
| 40. | Kiwi | *Actidinia deliciosa* |
| 41. | Apple | *Maleus spp.* |
| 42. | Apricot | *Prunus armeniaca* |

In addition, the following oils (and their associated plants) provide satisfactory components for the shrinkage prevention agent of the present invention:

| | |
|---|---|
| 1. | Oils, pine, *Pinus thunbergii* |
| 2. | Oils, pine, *Pinus densiflora* |
| 3. | Oils, spruce, *Pinea jezoensis* |
| 4. | Oils, hinoki wood |
| 5. | Oils, fir, *Ables firma* |
| 6. | Oils, camphor |
| 7. | Oils persimmon, *Diospyros kaki* |
| 8. | Oils, birch, *Betula platyphylla japonica* |
| 9. | Oils, mulbery, *Morus alba* |
| 10. | Oils, *Prunus yedoensis* |
| 11. | Oils, rice |
| 12. | Oils, tea, *Camnellia sinensis* |
| 13. | Oils *Sasa veitchii* |
| 14. | Oils, *Artemisisa princeps* |
| 15. | Oils, lavender, *Lavandul angustifolio* |
| 16. | Oils, *perilla frutescens* |
| 17. | Oils, *Gynostemma pentaphylla* |
| 18. | Oils, ginseng |
| 19. | Oils, carrott |
| 20. | Oils, *Phyllostachys edulis* |

As best as presently understood, the shrinkage prevention agent of the present invention preferably includes at least one organic acid from the above plants, with terpene and phenol as its effective components.

The system of water washing of the present invention is similar to conventional water washing with several significant differences. Use of 0.01–0.05 parts by volume of the shrinkage prevention agent of this invention per 100 parts by volume of regular water is presently understood to be preferable. The exact ratio can vary depending on the type of item being laundered, and can be modified and determined by those skilled in the cleaning art. Soaking of the clothing in the solution of water and shrinkage prevention agent, under a limited agitation cycle, causes the shrinkage prevention agent to cover the surfaces of the clothing fibers. As a result, shrinking of the fibers is suppressed by prevention of direct contact with water. Furthermore, the agent of this invention is permits the clothing to be suitable for tumble-drying, which is generally not the case for laundry with a conventional dry cleaning agent.

In the wet washing system of the present invention, the shrinkage prevention agent is mixed with water in the above-described proportions. The combined mixture is then added to the clothing under agitation in a large washing drum. It is believed to be important to the present invention to limit the amount of agitation of the clothing in the cleaning mixture to less than the agitation encountered in conventional dry cleaning with perc as well as less than the agitation encountered in conventional wet washing. The agitation is limited on account of the understanding that too much mechanical action on the clothing fibers can limit or overcome the shrinkage prevention effect of the agent. As previously explained, the shrinkage prevention agent must be permitted to contact the clothing and then act to prevent the entry of water into the fibers. In the washing cycle, the clothing is preferably soaked in the cleaning mixture of water and shrinkage prevention agent for 2–6 minutes, which is then followed by the limited agitation or mechanical action.

It is also presently preferred to add the cleaning mixture of water and shrinkage prevention agent to the clothing in the soaking cycle by the use of microbubble generation. Microbubbles, or very small bubbles, of the cleaning mixture are formed by the rapid mixing or stirring of air and water with the shrinkage prevention agent. Microbubbles can be generated by establishing a turbulent flow of the water and air mixture. One type of microbubble generator that has been developed for use with the system of the present invention involves a restrictor in the air flow conduit that includes a dimpled or roughened surface, which creates a turbulent flow stream as the air passes over and around the restrictor. The microbubbles of air, water and shrinkage prevention agent are formed before the microbubbles contact the clothing in the soak or agitation cycle.

Microbubbles assist the cleaning action on account of the bursting of the bubble as it contacts the clothing. The bursting of the microbubble creates an ultrasonic wave, which acts to remove the contaminants from the clothing in a cleaning action. Moreover, the generation of the microbubbles is understood to assist in the mixing and distribution of the shrinkage prevention agent throughout the water portion of the mixture. The surfactant tendency of the shrinkage prevention agent then acts to seal or contact the fibers and then repel the water portion of the mixture.

Following the soaking and limited agitation cycles, the drum with clothing is placed through a limited spin cycle to remove a portion of the cleaning mixture. The clothing is then placed through a tumble drying cycle to evaporate the remaining water from the clothing. It is presently understood that tumble drying the clothing at a temperature of about 70–80 degrees C. causes the evaporation of the water while allowing the shrinkage prevention agent to remain in the clothing fibers. The shrinkage prevention agent permits tumble drying of the clothing following the wet washing cycle, since the shrinkage prevention agent has prevent the fibers from absorbing the water from the wash cycle. The drying cycle times for the wet washing system of the present invention have been found to be generally of much less time duration than the drying cycles in conventionally dry cleaned clothing. However, increased power requirements are typically necessary in light of the additional volumes of hot air required for the system of the present invention. Since water must be evaporated from the clothing, greater amounts of hot air are required than conventionally required for removal of perc from clothing.

Several examples are used below to explain the invention, but the scope of the present invention is not to be limited to these examples.

EXAMPLE 1

Preparation of the Shrinkage Prevention Agent

Water, 50 liters, is added to 10 kilograms each of beefsteak plant leaves, tea leaves, sagebrush and aloe. Steam distillation is carried out for 30 minutes and the oil component is removed from the collected steam distillation liquid. Accordingly, 5 liters of steam distillation liquid was produced from each of the above-described plants. Also, 5 kilograms each of pine leaves, cedar leaves and cypress leaves were vacuum dry-distilled (in a final vacuum of 20 mmHg, with a final heating temperature: 200° C.). The initial fraction with lower alcohol, acetone, and similar components, was discarded and 1 liter of vacuum dry-distilled liquid of each plant was produced.

A mixture of 500 milliliters of each of the steam and vacuum dry-distilled liquids was combined to form a base liquid of shrinkage prevention agent. The results of a gas chromatographic analysis of this shrinkage prevention agent base liquid uncovered the following components:

| | |
|---|---|
| acetic acid | 1.40 weight % |
| cyclotene | 0.12 weight % |
| 2-cyclopentanone | 0.03 weight % |
| para-cresol | 0.03 weight % |
| meta-cresol | 0.04 weight % |
| ortho-cresol | 0.07 weight % |
| furfuryl alcohol | 0.02 weight % |
| guaiacol | 0.04 weight % |
| ethylguaiacol | 0.01 weight % |

EXAMPLE 2

Water Washing of Clothing by using the above Shrinkage Prevention Agent

A quantity of 10 milliliters of the base liquid of shrinkage prevention agent was added to 16 kilograms of items to be dry cleaned, which had been immersed into 70 liters of water. The clothing was washed with water in the above-described manner with a soak cycle followed by a limited agitation cycle and then a spin cycle. Tumble drying was used to remove the remaining moisture from the clothing. The clothing was washed without the addition of another detergent. After washing and drying, the items were checked for shrinkage. No shrinkage was revealed and these items had a soft washed texture. In addition, the oil-soluble and water-soluble soil contaminants were found to have been removed from the clothing.

EXAMPLE 3

Water, 50 liters, was added to 10 kilograms each of beefsteak plant leaves, plantaginales, green tea leaves, chrysanthemum leaves and the mixture was steam distilled for 30 minutes. The oil was removed from the collected steam distillation liquid to produce 5 liters steam distillation liquid of each plant component. A quantity of 500 milliliters of each of these steam distillation liquids were mixed to obtain the shrinkage prevention agent base liquid. Regular washing in water was carried out in the same way as in Example 2 without another detergent. The dried items were checked for shrinkage, but none was detected. Both oil-soluble and water-soluble soil was found to have been removed from the clothing.

EXAMPLE 4

Pine leaves, cedar leaves and cypress leaves, in quantities of 5 kg each, were vacuum dry-distilled (final vacuum: 20 mm Hg, final heating temperature: 200° C.). The initial fraction containing lower alcohol and acetone was discarded to produce 1 liter each of vacuum dry-distilled liquid with the mixture. 500 milliliters of these liquids were mixed to obtain a shrinkage prevention agent base liquid. Washing in water, as described in Example 2, was carried out without the use of another detergent. After drying, the laundry items did not show evidence of shrinkage and both oil-soluble and water-soluble soil were found to have been removed.

It will thus be seen the present invention provides a novel shrinkage prevention agent, and a novel wet cleaning system, having a number of advantages and characteristics, including those pointed out herein and others which are inherent in the invention. Several preferred embodiments having been described by way of illustration, it is anticipated that modifications to the described forms of product, system and method will occur to those skilled in the art and that such modification and changes may be made without departing from the spirit of the invention or the scope of the appended claims.

What is claimed is:

1. A shrinkage prevention agent for use with clothing being washed in water, said agent having a composition comprising a plurality of plant components, said plurality of plant components including two or more types of naturally occurring plants selected from the group of plants consisting essentially of sagebrush, beefsteak plant, tea, aloe, and chrysanthemum, said plant components being the residual product of said naturally occurring plants that have been treated by a distillation process, and at least one organic acid, said organic acid including terpene and phenol.

2. The shrinkage prevention agent of claim 1 wherein said two or more types of naturally occurring plants are treated by steam distillation, said steam distillation includes the removal of oil from the surface of the liquid formed by said steam distillation.

3. The shrinkage prevention agent of claim 1 wherein said two or more types of naturally occurring plants are treated by vacuum distillation.

4. The shrinkage prevention agent of claim 3 wherein said vacuum distillation includes the removal of lower alcohol and acetone from the initial fraction of liquid.

5. The shrinkage prevention agent of claim 1 wherein said agent includes a steam distilled liquid formed from two or more types of naturally occurring plants and a vacuum distilled liquid from two or more types of naturally occurring plants, said steam distillation includes the removal of oil from the surface of the liquid formed by said steam distillation, and said vacuum distilled liquid each including at least one organic acid, said organic acid having terpene and phenol.

6. The shrinkage prevention agent of claim 1 wherein said agent is formed from a base liquid consisting essentially of the following components: acetic acid, cyclotene, 2-cyclopentanone, para-cresol, meta-cresol, ortho-cresol, furfuryl alcohol, guaiacol, and ethylguaiacol.

7. The shrinkage prevention agent of claim 6 wherein said agent is formed from a base liquid comprising the following components:

| | |
|---|---|
| acetic acid | 1.40 weight % |
| cyclotene | 0.12 weight % |
| 2-cyclopentanone | 0.03 weight % |
| para-cresol | 0.03 weight % |
| meta-cresol | 0.04 weight % |
| ortho-cresol | 0.07 weight % |
| furfuryl alcohol | 0.02 weight % |
| guaiacol | 0.04 weight % |
| ethylguaiacol | 0.01 weight % |

8. A method for cleaning clothes comprising the steps of:

contacting said clothing with a cleaning solution, said cleaning solution comprising water in combination with a shrinkage prevention agent, said agent having a composition including a plurality of plant components, said plurality of plant components including two or more types of naturally occurring plants selected from the group of plants consisting essentially of sagebrush, beefsteak plant, tea, aloe, and chrysanthemum, said plant components being the residual product of said naturally occurring plants that have been treated by a distillation process, and said agent composition including at least one organic acid, said organic acid including terpene and phenol, removing the cleaning solution from said clothing, and drying the clothing.

9. The method for cleaning clothes of claim 8 wherein said contacting step includes the formation of microbubbles with components of a mixture of air, water and said distilled liquid, said microbubble formation being accomplished by turbulent mixing of said microbubble components.

10. The method for cleaning clothes of claim 9 wherein said contacting step includes soaking of said clothing in said microbubbles followed by agitation of said clothing in said microbubbles.

11. The method for cleaning clothes of claim 8 wherein said drying step includes tumble drying of said clothing.

12. A solution for cleaning of clothing comprising a mixture of water in combination with a shrinkage prevention agent, said agent having a composition including a plurality of plant components, said plurality of plant components including two or more types of naturally occurring plants selected from the group of plants consisting essentially of sagebrush, beefsteak plant, tea, aloe, and chrysanthemum, said plant components being the residual product of said naturally occurring plants that have been treated by a distillation process, and said agent composition including at least one organic acid, said organic acid including terpene and phenol.

13. The solution for cleaning clothing of claim 12 wherein said mixture includes the formation of microbubbles with components of a mixture of air, water and said distilled liquid, said microbubble formation being accomplished by turbulent mixing of said microbubble components.

14. An apparatus for cleaning clothes comprising:

a first solution contacting tank for containing a shrinkage prevention agent, said shrinkage prevention agent having a composition including a plurality of plant components, said plurality of plant components including two or more types of naturally occurring plants selected from the group of plants consisting essentially of sagebrush, beefsteak plant, tea, aloe, and chrysanthemum, said plant components being the residual product of said naturally occurring plants that have been treated by a distillation process, and said agent composition including at least one organic acid, said organic acid including terpene and phenol, and an agitation tank contacting clothing with a solution of said shrinkage prevention agent and water, said agitation tank permitting a soak period without movement of said clothing within said tank and an agitation period of limited movement of said clothing within said tank.

15. The apparatus of claim 14 wherein said apparatus includes a microbubble generator for the formation of microbubbles with components of a mixture of air, water and said shrinkage prevention agent, said microbubble formation being acomplished by turbulent mixing of said microbubble components.

16. The apparatus of claim 9 wherein said soak period includes soaking of said clothing in said microbubbles and said agitation period includes movement of said clothing in said microbubbles.

* * * * *